US006253966B1

(12) United States Patent
Dinkel

(10) Patent No.: US 6,253,966 B1
(45) Date of Patent: Jul. 3, 2001

(54) DISCHARGE BOOSTER FOR PROMOTING A FLOW OF BULK MATERIAL

(75) Inventor: Michael Dinkel, Heitersheim (DE)

(73) Assignee: GEA Powder Technology GmbH, Mullheim (DE)

( * ) Notice: Subject to any disclaimer, the term of this patent is extended or adjusted under 35 U.S.C. 154(b) by 0 days.

(21) Appl. No.: 09/503,344

(22) Filed: Feb. 14, 2000

(30) Foreign Application Priority Data

Feb. 12, 2000 (DE) ..... 199 06 031

(51) Int. Cl.[7] ..... B65D 83/00
(52) U.S. Cl. ..... 222/198; 222/200; 222/481.5
(58) Field of Search ..... 222/196, 185.1, 222/198, 200, 481.5

(56) References Cited

U.S. PATENT DOCUMENTS 3,703,247 * 11/1972 Kostur ..... 222/481.5
4,030,452 * 6/1977 Keen et al. ..... 222/200
4,240,365 * 12/1980 Amburn ..... 222/200
5,540,266 7/1996 Grau et al. .
5,875,935 3/1999 Koch et al. .
6,116,471 * 9/2000 Miller ..... 222/199

* cited by examiner

*Primary Examiner*—Joseph A. Kaufman
*Assistant Examiner*—David Deal
(74) *Attorney, Agent, or Firm*—Burns, Doane, Swecker & Mathis, LLP

(57) ABSTRACT

A discharge booster for slow-flowing bulk material, which is to be unloaded from a container, whereby the container comprises a bottom, a discharge port at the bottom that may be sealed by a shutoff valve, a shaking device and a ventilation body. The ventilation body extends upwardly from the discharge port in the to at least the maximum dumping height in the container. The ventilation body is vibratable to beat open a passageway in the bulk material for venting a void above the bulk material in the container, to prevent the creation of a vacuum which could resist the discharge of the bulk material.

9 Claims, 2 Drawing Sheets

DISCHARGE BOOSTER FOR PROMOTING A FLOW OF BULK MATERIAL

BACKGROUND OF THE INVENTION

The invention relates to a discharge booster for slow-flowing bulk material, which is to be unloaded from a container whereby the container comprises a bottom, a discharge port that may be sealed by a shutoff valve, a top, a center piece, and a shaking device.

A known discharge booster depicted in FIG. 2 is disclosed in U.S. Pat. No. 5,875,935 (corresponding to DE 196 41827 C1), the disclosure of which is incorporated herein by reference. That booster, disposed at a lower discharge end of a vessel 10, includes an annular flange 12*a* coupled to a connecting flange 15*a*, and a flexible adapter 20*a* disposed between the flanges 12*a*, 15*a*. A shaking device 30 is mounted atop the connecting flange 15*a*.

The connecting flange 15*a* constitutes a first connecting piece which is to be releasably connected to a second connecting piece 16*a* carried by another container. Seals 22*a*, 24*a* are mounted at inner surfaces of the connecting pieces 15*a*, 16*a*, respectively. The first and second connecting pieces 15*a*, 16*a* are respectively provided with a passive shutoff valve 14 and an active shutoff valve 28*a*, each valve being in the shape of a pivotable sealing flap gate. The gates are moved from a closed position to an open position by an oscillation drive (not shown) connected to the active gate. The active gate thus rotates the passive gate. Movements produced by operation of the drive and the gates produce vibrations that are conducted to the shaking device 30 to vibrate the latter. Vibrators 29*a* could be mounted on the connecting piece 16 to augment the vibrations.

Vibrations in the container 10 are caused by the movement of the shaking device 30, which will break down, or prevent possible arching of, the bulk material in the container to continuously maintain a bulk material flow for the purpose of emptying the container. It has been found, however, that the known discharge boosters with driven shaking devices still do not guarantee uninterrupted discharging of bulk material from a container. Continuous out-flowing of bulk material is actually prevented when a vacuum is created in a void disposed within the container above the bulk material in response to a discharging of the bulk material.

It is customary at the present to counteract the build-up of a vacuum in that void by providing external ventilation connections, or lifting temporarily the cover of the upper container which seals the upper filler opening. This is, of course, in contradiction with clean air laws, especially when the bulk material is a sensitive material or is hazardous to one's health.

It is therefore the object of the invention to further develop the state of the discharge booster whereby the disadvantages of the current state-of-the-art are overcome and to ventilate the void in a simple manner, without contamination of the environment or the bulk material.

SUMMARY OF THE INVENTION

This object is achieved according to the invention by utilization of a ventilation body that essentially leads from the discharge port upwardly to at least the maximum dumping height in the container and which may be moved together with a shaking device, to break open a passageway within the bulk material to vent the void above said bulk material in the container.

Thereby it may be preferably planned that the ventilation body is connected to the shaking device.

A further development of the invention is characterized by a spring, which is connected to the ventilation body and the shaking device.

It is also suggested that the ventilation body is provided with a smooth surface to make cleaning easier.

It may also be planned that the ventilation body is flexible (elastic). According to the invention it may further be planned that the ventilation body is disposed along a vertical center axis of the container.

A special embodiment of the invention is characterized in that the ventilation body is designed in the shape of a rod, preferably with an essentially round cross section.

It is also suggested according to the invention that the discharge port is provided with an annular flange, which may be coupled with a connecting flange, that the annular flange of the container and the connecting flange may be moved against one another, and that the shaking device may be moved over the connecting flange.

Thereby it is preferably suggested that the connecting flange is part of a first tubular connection piece in a device for coupling two containers having one tubular connection piece each, wherein each tubular connection piece is provided with a movable shutoff valve near the opposed end of its supporting container, particularly in the shape of a pivotable sealing flap gate. The shutoff valves are changed from a closed position to an open position by means of only one of the oscillating drives actuating the shutoff valve. The driven shutoff valve is held in place in the second connection piece and may be actuated by said drive. Furthermore, the second tube connection piece is mounted in a floating manner so that an oscillating movement, caused by the drive, may be transferred through the two tube connection pieces to the shaking device and the ventilation body.

The invention is therefore based on the surprising knowledge that a ventilation body may be moved together with the shaking device whereby said ventilation body leads through the bulk material upward to at least the maximum dumping height of the bulk material in the container, starting from the discharge port at the container bottom and leading in the direction of the container top, to beat open a ventilating passageway through the bulk material to the voidage above said bulk material in the container.

BRIEF DESCRIPTION OF THE DRAWING

Additional characteristics and advantages of the invention can be found in the subsequent description in which an embodiment example is described in detail with the aid of a schematic drawing wherein.

DETAILED DESCRIPTION OF A PREFERRED EMBODIMENT OF THE INVENTION

Figure 1:
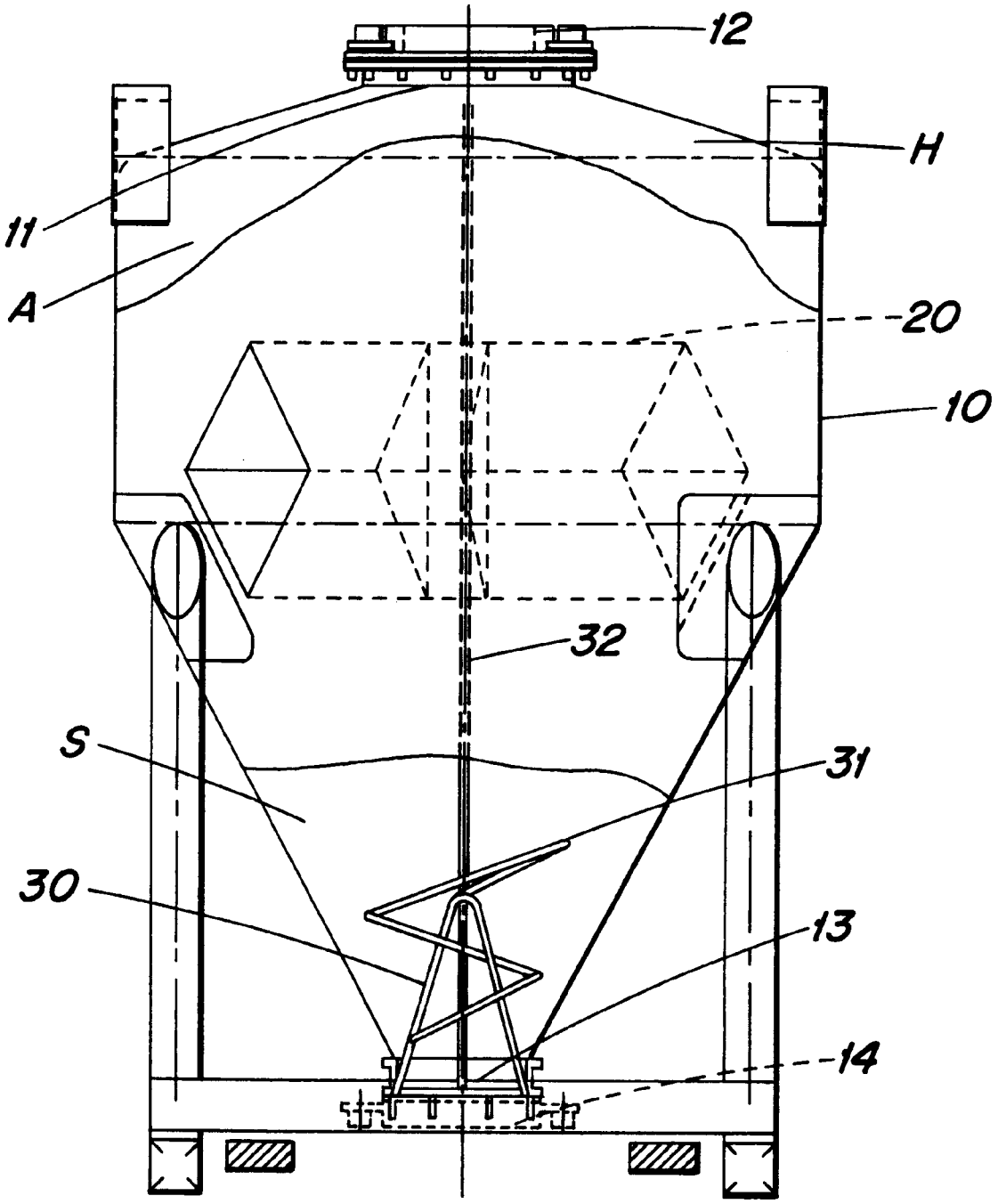
FIG. 1 depicts a container for bulk material with a discharge booster, according to the invention, in a partial cross-sectional view.

As can be seen in FIG. 1, the container 10 comprises a filler opening 11, which is built into the container top and which can be sealed by a cover 12, and a discharge port 13, which is built into the container bottom and which may be sealed by means of a flap gate 14 representing a shutoff valve. Inside the container 10 there is arranged a mixing device 20 for thorough mixing of the bulk material S. and a shaking unit comprised of a shaking device 30 and a spring 31 connected thereto, to prevent, or break down, bulk material arches (bridges). Furthermore, there is provided in the container, according to the invention, a ventilation rod 32 that is connected to the shaking unit 30, and thus indirectly to the spring 31. Said ventilation rod extends from the discharge port 13 in the direction of the filler opening 11 up to a point close to the cover 12. The ventilation rod 32 protrudes upwardly past the maximum dumping height A for the bulk material in said container 10 to reach into the void H between the maximum dumping height A and the top of said container 10 or the cover 12 thereof.

Described below is the operation of the innovative discharge booster in the container 10.

Figure 2:
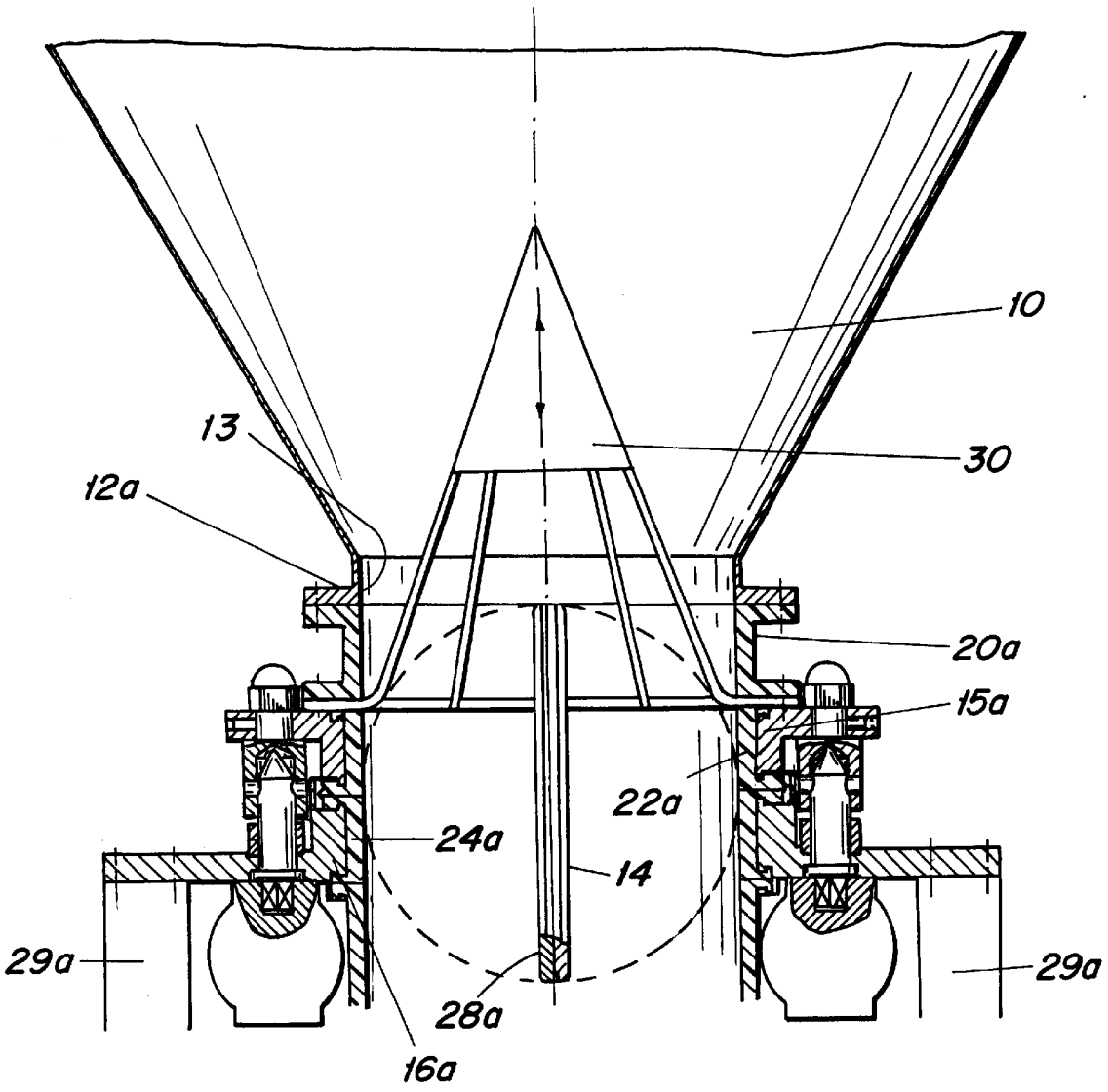
Fig. 2 (PRIOR ART)
FIG. 2 depicts a prior art container.

The container 10 is mobile and its flap gate 14 represents a passive sealing flap gate. The mobile container 10 may be moved across the top of a stationary container (not shown), particularly a production unit such as a pill press, a mixer, a dryer, a reactor or the like, to be coupled therewith. Said mobile container 10 is moved in such a manner that its discharge port 13 is lined up with a filler opening of a production unit. The passive flap gate 14 of said mobile container 10 may then be coupled with an active flap gate 28*a* of the production unit (see FIG. 2). Reference is made to the disclosure of U.S. Pat. No. 5,540,266 (corresponding to DE 43 42 962 C1) in regard to exact details of the active and passive sealing flap gates, that disclosure being incorporated herein by reference.

When the bulk material S is to be unloaded from the mobile container 10 into the coupled stationary production unit, the active flap gate of said production unit is forced from a closed position into an open position by means of an oscillating drive whereby the active flap gate moves together with the passive flap gate 14 of said mobile container 10 during its movement from the closed position, shown in FIG. 1, to the open position.

Together with the opening of a passageway from said container 10 to said production unit, vibration is simultaneously initiated via the active flap gate by a vibrator 29*a* in the production unit, or in the bulk material S, by means of the shaking device 30 whereby the vibration causes the passive flap gate 14 to counteract the problem of arch-forming in the bulk material S, which would make unloading of said bulk material impossible.

In addition, vibration is transferred through the flap gate 14, the shaking device 30 and the spring 31 to the ventilation rod 32, which subsequently beats open a vertical passageway in the bulk material for venting the void H through the opening 13 in reaction to said vibration.

According to the invention, it is especially advantageous that most of the parts that are to be placed in movement, namely, the active flap gate together with the oscillating drive and the vibrator, are arranged on the production unit so that the mobile container 10 may be moved back and forth without cables.

The disclosed characteristics of the invention in the above description, drawings and the claims may be substantial for the realization of the invention in their various embodiments by themselves or also in any desired combination.

What is claimed is:

1. A container for dispensing slow-flowing bulk material, comprising:

a container body including an upper end and a lower end, the lower end including a bottom discharge port;

a shut-off valve for opening and closing the port, a shaking unit for transmitting vibrations to bulk material to promote downward flowing of the flowing material when the shut-off valve is open; and a vibration body extending from adjacent the discharge port to adjacent the upper end and being vibratable for beating open a passageway through the bulk material for venting the upper end through the discharge port to avoid the creation of a flow-resisting vacuum above the bulk material.

2. The container according to claim 1 wherein the vibration body is connected to the shaking unit.

3. The container according to claim 2 wherein the shaking unit includes a shaking device and a coil spring connected thereto.

4. The container according to claim 1 wherein the ventilation body includes a smooth outer surface.

5. The container according to claim 1 wherein the ventilation body is flexible.

6. The container according to claim 1 wherein the ventilation body extends along a vertical center axis of the container.

7. The container according to claim 1 wherein the vibration body comprises a rod.

8. The container according to claim 7 wherein the rod has a circular cross section.

9. In combination, upper and lower containers;

the lower container including a lower tubular piece forming an upwardly facing inlet, and a first shutoff valve mounted in the inlet;

the upper container including an upper end, a lower outlet aligned with the inlet, and an upper tubular piece having a second shut-off valve arranged for rotation simultaneously with the first shut-off valve;

one of the upper and lower shut-off valves being driven to rotate the other of the shut-off valves;

a shaking unit mounted in the upper container for transmitting vibrations to the bulk material to promote downward flowing thereof when the shut-off valves are open;

a vibration body extending from adjacent the discharge port to adjacent the upper end and being vibratable for beating open a passageway through the bulk material for venting the upper end through the discharge port to avoid the creation of a flow-resisting vacuum above the bulk material.

* * * * *

UNITED STATES PATENT AND TRADEMARK OFFICE

CERTIFICATE OF CORRECTION

PATENT NO. : 6,253,966 B1
DATED : July 3, 2001
INVENTOR(S) : Michael Dinkel

It is certified that error appears in the above-identified patent and that said Letters Patent is hereby corrected as shown below:

Title page,
Item [30], Foreign Application Priority Data,
correct to -- Feb 12, 1999 (DE) ……. 199 06 031 --

Signed and Sealed this

Thirtieth Day of July, 2002

*Attest:*

*Attesting Officer*

JAMES E. ROGAN
*Director of the United States Patent and Trademark Office*